United States Patent [19]

Koch et al.

[11] 4,144,183

[45] * Mar. 13, 1979

[54] MIXED BRANCHED AND STRAIGHT CHAIN ESTER OILS

[75] Inventors: Karlheinz Koch, Haan; Hermann Kroke, Erkrath-Unterbach, both of Fed. Rep. of Germany

[73] Assignee: Henkel Kommanditgesellschaft auf Aktien, Dusseldorf-Holthausen, Fed. Rep. of Germany

[ * ] Notice: The portion of the term of this patent subsequent to Oct. 11, 1994, has been disclaimed.

[21] Appl. No.: 818,077

[22] Filed: Jul. 22, 1977

Related U.S. Application Data

[63] Continuation-in-part of Ser. No. 602,825, Aug. 7, 1975, Pat. No. 4,053,491, which is a continuation-in-part of Ser. No. 428,887, Dec. 27, 1973, abandoned.

[30] Foreign Application Priority Data

Jan. 22, 1973 [DE] Fed. Rep. of Germany ..... 2302918

[51] Int. Cl.[2] ..... C09F 5/08; C11C 3/00; C10M 1/24

[52] U.S. Cl. ..... 252/56 S; 260/410.6

[58] Field of Search ..... 260/410.6; 252/56 S

[56] References Cited

U.S. PATENT DOCUMENTS

| | | | |
|---|---|---|---|
| 3,282,971 | 11/1966 | Metro et al. | 260/410.6 |
| 3,673,226 | 6/1972 | Malec | 260/410.6 |
| 3,778,454 | 12/1973 | Kleiman et al. | 252/56 S |
| 4,025,447 | 5/1977 | Mancini et al. | 260/410.6 |
| 4,053,491 | 10/1977 | Koch et al. | 260/410.6 |
| 4,061,581 | 12/1977 | Leleu et al. | 252/56 S |

*Primary Examiner*—John Niebling

*Attorney, Agent, or Firm*—Hammond & Littell

[57] ABSTRACT

Branched-chain aliphatic ester oils comprising full esters of branched-chain aliphatic polyols having from 2 to 6 hydroxyl groups with mixtures of saturated, branched-chain, aliphatic monocarboxylic acids having from 14 to 22 carbon atoms and saturated straight-chain aliphatic monocarboxylic acids having from 8 to 10 carbon atoms, as well as their use alone, or as mixture components, as lubricants or hydraulic fluids.

11 Claims, No Drawings

MIXED BRANCHED AND STRAIGHT CHAIN ESTER OILS

REFERENCE TO A PRIOR APPLICATION

This application is a continuation-in-part of our copending U.S. Patent application Ser. No. 602,825, filed Aug. 7, 1975, now U.S. Pat. No. 4,053,491, which, in turn, was a continuation-in-part of U.S. Patent application Ser. No. 428,887, filed Dec. 27, 1973, and now abandoned.

THE PRIOR ART

So-called ester oils have found in the last few years a wide field of application as valuable lubricants. Thus, for example, for the lubrication of turbine engines of jet-propelled aircraft, esters of dicarboxylic acids and alcohols with medium chain length, such as, for example, dioctyl sebacate, or esters of various polyols with fatty acids with a medium chain length are used. More recently, such ester oils have also been used to an increased extent for other lubrication problems where the lubricating requirements are high, as for example, as mixing components in partly synthetic engine oils. The special suitability of the ester oils for these purposes is based on the facts that, compared with the usual lubricants based on mineral oil, they have a far more favorable behavior of viscosity with temperature and that, compared with substances of comparable viscosities, the pour point is distinctly lower. These properties also represent an essential requirement for the suitability of an oil as the operating fluid in hydraulic systems, since its viscosity is only allowed to alter to an insignificant extent with considerable temperature variations and besides it must also remain capable of use at low temperatures.

It is common knowledge to the technician that ester oils of higher viscosity usually prove less satisfactory in their behavior in the cold, since the increase of the viscosity generally accompanies an increase of the pour point. For lubrication problems which absolutely necessitate the use of more highly viscous ester oils, so-called complex esters have been recently developed. These contain as esterification components both diols or polyols and dicarboxylic acids in addition to monofunctional alcohols or acids, in order to be able to prepare esters with low acid and hydroxyl numbers. The viscosities of such complex esters lie at 100° F. at about 30 to 300 cSt and at 210° F. at 10 to 30 cSt. The pour points of such highly viscous complex esters do not generally lie below −30° C. Therefore, they are not satisfactory in this respect for many purposes of use. A further serious disadvantage of these complex esters is that their preparation causes great difficulties, since during the esterification of polyfunctional acids with polyfunctional alcohols, undesired polymerizations must be contemplated and controlled, if possible. The acid fractions or fractions of partial esters remaining in the complex ester after the esterification reaction can only be removed with difficulty by refining or distillation.

It has also already been attempted to prepare more highly viscous ester oils by esterification of polyfunctional alcohols with straight-chain monocarboxylic acids. If, however, the preparation of esters with high viscosities comparable with those possessed by the complex esters is desired, products are obtained of which the pour points rise to values above 0° C. As may be seen from the following Table I, a viscosity of over 30 cSt at 100° F. with a trimethylolpropane ester can be obtained when an addition of fatty acids of chain lengths over $C_{10}$ is made as the esterification component. If, for example, lauric acid is used as esterification component, a trimethylolpropane ester with a viscosity of 36.4 cSt at 100° F. is obtained, but with a pour point of +7° C. The corresponding lauric acid-neopentylglycol ester has already a pour point of +11° C. with a viscosity of only 16.2 cSt at 100° F.

TABLE I

| Ester | Pour Point in ° C. | Viscosity in cSt at 100° F. | Viscosity Index |
|---|---|---|---|
| Trimethylolpropane | | | |
| n-$C_6$-acid | −60 | 12.1 | 113 |
| n-$C_7$-acid | −60 | 14.6 | 128 |
| n-$C_8$-acid | −54 | 18.8 | 138 |
| n-$C_9$-acid | −51 | 22.4 | 143 |
| n-$C_{10}$-acid | −29 | 26.2 | 145 |
| n-$C_{12}$-acid | + 7 | 36.4 | 143 |
| Neopentylglycol | | | |
| n-$C_7$-acid | −62 | 5.95 | 116 |
| n-$C_9$-acid | −27 | 9.18 | 113 |
| n-$C_{10}$-acid | −27 | 11.3 | 145 |
| n-$C_{12}$-acid | +11 | 16.2 | 167 |

Further, the preparation of ester oils based on polyols and branched-chain fatty acids of medium chain length has already been attempted. When these fatty acids or mixtures of branched-chain and straight-chain fatty acids of medium chain length are used, the pour point of the esters obtained is indeed distinctly lower, but this advantage is offset by disadvantages in the behavior of the viscosity with temperature, as products result with a low viscosity index, as may be seen from the following collected results of Table II.

TABLE II

| Ester | Pour Point in ° C. | Viscosity in cSt at 100° F. | Viscosity in cSt at 210° F. | Viscosity Index |
|---|---|---|---|---|
| Trimethylolpropane | | | | |
| n-$C_8$-acid | −54 | 19.0 | 4.09 | 138 |
| i-$C_8$-acid | −54 | 27.1 | 4.72 | 85 |
| 2-ethyl-hexanoic acid | −58 | 26.3 | 4.8 | 80 |
| mix-$C_8$-acid | −62 | 19.1 | 3.92 | 115 |
| Pentaerythritol | | | | |
| n-$C_9$-acid | + 1 | 34.7 | 6.23 | 135 |
| i-$C_9$-acid | −34 | 129.2 | 11.60 | 82 |
| mix-$C_9$-acid | −60 | 47.3 | 7.07 | 116 |

Our parent application, Ser. No. 602,825, now U.S. Pat. No. 4,053,491, describes a series of branched-chain aliphatic ester oils having pour points of below −50° C., viscosities at 100° F. of about 30 cSt or over and Viscosity Indexes of 120 or over, consisting essentially of a full ester of a branched-chain aliphatic polyol having only from 2 to 6 primary hydroxyl groups selected from the group consisting of alkanepolyols having from 3 to 6 carbon atoms and alkoxyalkanepolyols having from 6 to 12 carbon atoms with α-branched-chain alkanoic acids having the formula

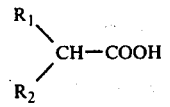

wherein $R_1$ and $R_2$ are straight-chained alkyl having from 1 to 19 carbon atoms and the total number of carbon atoms in the acid is from 14 to 22, said acids being selected from the group consisting of (1) acids derived from the oxidation of α-branched alcohols formed from normal alcohols by the Guerbet synthesis and (2) an acid of the formula

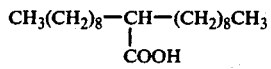

OBJECTS OF THE INVENTION

An object of the present invention is the development of ester oils which, besides a very low pour point, have in comparison a high viscosity, and are at the same time satisfactory in their viscosity temperature behavior.

Another object of the invention is the development of a branched-chain aliphatic ester oil consisting essentially of a full ester of a branched-chain aliphatic polyol having from 2 to 6 primary hydroxyl groups selected from the group consisting of alkanepolyols having from 3 to 6 carbon atoms and alkoxyalkanepolyols having from 6 to 12 carbon atoms with a mixture of (A) α-branched-chain alkanoic acids having the formula

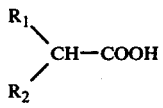

wherein $R_1$ and $R_2$ are alkyl having from 1 to 19 carbon atoms and the total number of carbon atoms in the acid is from 14 to 22, selected from the group consisting of (1) acids derived from the oxidation of α-branched alcohols formed from normal alcohols by the Guerbet synthesis and (2) an acid of the formula

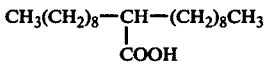

and (B) straight-chain alkanoic acids having from 8 to 10 carbon atoms, in such a ratio wherein at least one of said primary hydroxyl groups is on average at least 80% esterified by said α-branched-chain alkanoic acids and at least one of said primary hydroxyl groups is on average at least 40% esterified by said straight-chain alkanoic acids.

A further object of the invention is the development of lubricating and hydraulic fluid compositions containing from 20% to 100% of at least one of the above branched-chain aliphatic ester oils.

A yet further object of the present invention is the improvement in the method of facilitating the motion of one solid over the surface of another solid by interspersing a thin film of a lubricant between the surfaces of said solids in frictional contact which consists of employing the above branched-chain aliphatic ester oils as said lubricant.

These and other objects of the invention will become more apparent as the description thereof proceeds.

DESCRIPTION OF THE INVENTION

It has now been found that ester oils consisting of the full esters of a) branched, aliphatic polyols having 2 to 6 primary hydroxyl groups, and
b) a mixture of saturated, α-branched-chain, aliphatic monocarboxylic acids with a total of 14 to 22 carbon atoms in the molecule and saturated straight-chain aliphatic monocarboxylic acids with 8 to 10 carbon atoms satisfy the necessary requirements of a very low pour point, preferably −45° or below, a high thermal stability, a high viscosity, preferably above about 20 cSt at 100° F., and a satisfactory viscosity-temperature behavior, preferably a viscosity index of over 120, to an extent not previously attained.

More particularly, the ester oil of the invention is a branched-chain aliphatic ester oil consisting essentially of a full ester of a branched-chain aliphatic polyol having from 2 to 6 primary hydroxyl groups selected from the group consisting of alkanepolyols having from 3 to 6 carbon atoms and alkoxyalkanepolyols having from 6 to 12 carbon atoms with a mixture of (A) α-branched-chain alkanoic acids having the formula

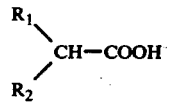

wherein $R_1$ and $R_2$ are alkyl having from 1 to 19 carbon atoms and the total number of carbon atoms in the acid is from 14 to 22, selected from the group consisting of (1) acids derived from the oxidation of α-branched alcohols formed from normal alcohols by the Guerbet synthesis and (2) an acid of the formula

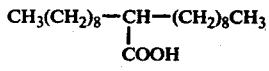

and (B) straight-chain alkanoic acids having from 8 to 10 carbon atoms, in such a ratio wherein at least one of said primary hydroxyl groups is on average at least 80% esterified by said α-branched-chain alkanoic acids and at least one of said primary hydroxyl groups is on average at least 40% esterified by said straight-chain alkanoic acids. The properties of the esters of the invention are clearly improved over the esters of Table I.

As the alcoholic component, all branched-chain aliphatic polyols having 2 to 6 primary hydroxyl groups from the basis of the ester oils according to the invention, such as the alkanepolyols having from 3 to 6 carbon atoms and the alkoxyalkanepolyols having from 6 to 12 carbon atoms, as for example, neopentylglycol, trimethylolpropane, pentaerythritol, or dipentaerythritol. The polyols trimethylolpropane and pentaerythritol are of particular importance.

Suitable acid components of the ester oils according to the invention are mixtures of saturated, α-branched-chain, aliphatic monocarboxylic acids with a total of 14 to 22 carbon atoms in the molecule and straight-chain alkanoic acids having 8 to 10 carbon atoms.

Of the α-branched-chain carboxylic acids having a total of 14 to 22 carbon atoms in the molecule obtainable in various ways, special importance is attached to those saturated, branched-chain carboxylic acids in which the chain branches in the α-position to the carboxyl group and the two alkyls of the chain branches are straight-chained. The preparation of such saturated, α-branched-chain carboxylic acids may be effected, for example, by the Guerbet reaction on unbranched saturated alcohols of medium chain length to give alcohols of the desired total number of carbon atoms, branched in the 2 position, which are subsequently oxidized to give a carboxyl group in place of the alcohol group. Another method, for example, is the hydrogenation of the $C_{20}$ carboxylic acid obtained by the reaction of 1,3-butadiene with methyl methacrylate in the presence of an organometal complex of zero valent nickel and an electron-donor and subsequent saponification, according to the German Patent (DOS) No. 2,025,830. The unsaturated ester is likewise described in U.S. Pat. No. 3,660,440. A nonadecanecarboxylic acid obtained in this way has, for example, the structure

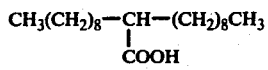

Other carboxylic acids branched in the α-position to the carboxyl group can also be obtained by oxidation of branched-chain alcohols from petroleum chemistry, as for example, by the oxidation of an isomeric mixture of branched-chain $C_{16}$ alcohols of the structure

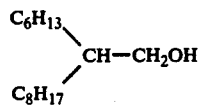

which can be prepared by aldol condensation of isooctylaldehyde, which itself is obtainable from isoheptene, which is formed during the cracking of petroleum. The two $C_6H_{13}$- and $C_8H_{17}$-groups of the carboxylic acids branched in the α-position so obtained are themselves also branched.

Particularly favorable results can be obtained with saturated, branched-chain, aliphatic monocarboxylic acids in which the chain is branched in the α-position to the carboxyl group, the branches are themselves straight-chain, and the total number of carbon atoms in the molecule of which is 16. Of the $C_{16}$-carboxylic acids branched in the α-position to the carboxyl group, isopalmitic acid obtained by oxidation of 2-hexyl-decanol formed from n-octanol in the Guerbet synthesis is of very special importance. The ester oils obtained by use of this isopalmitic acid show extremely favorable properties with respect to stability at high temperatures and behavior in the cold as well as of its viscosity behaviors.

The straight-chain alkanoic acids having 8 to 10 carbon atoms are preferably mixtures commercially available, although substantially pure n-octanoic acid, n-nonanoic acid or n-decanoic acid may be employed.

The amount of acids in the mixed esters depends on the amount of primary hydroxyl groups of the polyols. Preferably, sufficient of the α-branched-chain alkanoic acids are present wherein, on the average, at least one primary hydroxyl group is 80% esterified therewith. Also, sufficient of the straight-chain alkanoic acids are present wherein, on the average, at least one primary hydroxyl group is 40% esterified therewith. For example, with trimethylol propane containing 3 primary hydroxyl groups, the molar amount of branched-chain would be from 0.8 to 2.6 and the straight-chain acid, from 0.4 to 2.2, where the 3 hydroxyl groups are fully esterified. Preferably, at least one primary hydroxyl group is esterified with said branched-chain acid and at least one primary hydroxyl group with said straight-chain acid.

The esters according to the invention can be prepared by the usual esterification processes, such as by heating the reactants in the presence of an esterification catalyst, as for example, tin or aluminum powder, or p-toluenesulfonic acid and other substances. In the preparation of the mixed isopalmitic acid ester it has proved satisfactory to free the ester obtained from acid residues by washing with a short-chain alcohol, such as methanol. Obviously the purification of the crude reaction mixture from excess acid can also be carried out by washing with caustic alkali liquors.

The ester oils according to the invention are outstandingly suitable both alone, and in admixture with other products already known for this purpose, for use as lubricants and as hydraulic fluid, on account of their extremely favorable properties with regard to viscosity, behavior in the cold and thermo-stability. Such a favorable overall behavior cannot be obtained with all previously known ester oils obtainable in such a simple manner. Owing to their relatively high viscosity and their favorable viscosity behavior with temperature, the ester oils according to the invention can be used advantageously also in those fields which have previously been barred to the complex esters. When used as a mixture component in lubricants and hydraulic fluids, any desired mixing proportions can be selected, which are determined exclusively by the values required with respect to working behavior, pour point and viscosity-temperature behavior. In general, however, the total product does not contain a fraction less than 20%. Both mineral oils and other ester oils are suitable as mixing components, depending on the purpose of use. These compositions contain from 20% to 100% of the ester oils of the invention.

The following Examples further describe the invention without it being restricted thereto.

EXAMPLES

The full esters of the invention utilized for testing for behavior to cold and viscosity-temperature behavior were prepared from the polyols and the mixture of branched-chain carboxylic acids and straight-chain carboxylic acids as given below by the method outlined above of heating an excess of about 1.05 mol of the acid mixture for each mol equivalent of hydroxyl groups in the polyol in the presence of a p-toluene-sulfonic acid to a temperature of about 125° C. while removing the water produced by the reaction. The esters were recovered by washing the reaction mixture with methanol.

A = Neopentylglycol
B = Trimethylolpropane
C = Pentaerythritol
D = Isopalmitic acid, obtained by oxidation of the 2-hexyl-decanol formed from n-octanol by oxidation in the Guerbet synthesis
E = A mixture of straight-chained alkanoic acids having 8 to 10 carbon atoms.

The values obtained during the tests are given in the following Table III.

TABLE III

| Full Ester | Pour Point in ° C | Viscosity in cSt at 100° F | Viscosity in cSt at 210° F | Viscosity Index |
|---|---|---|---|---|
| A + 1D and 1E | <−60 | 16.6 | 3.73 | 124 |
| B + 0.8D and 2.2E | <−60 | 31.57 | 5.85 | 143 |
| B + 1D and 2E | −62 | 34.0 | 6.1 | 139 |
| B + 1.36D and 1.64E | <−60 | 36.6 | 6.32 | 135 |
| B + 1.46D and 1.54E | <−60 | 40.1 | 6.66 | 131 |
| B + 1.78D and 1.22E | −56 | 42.8 | 6.97 | 133 |
| C + 3.58D and 0.42E | −45 | 69.1 | 10.0 | 139 |

From the above Table III the extremely favorable properties for technical use of the ester oils according to the invention with reference to behavior to cold and of viscosity temperature behavior can be clearly noted. In spite of their relatively high viscosities and their favorable viscosity-temperature behavior (viscosity index), the products have an extremely low pour point of well below −30° C.

Mixtures falling outside of the specified ratio of acids suffer from either having a low viscosity at 100° F. or a low pour point.

The previous specific embodiments are illustrative of the practice of the invention. It is to be understood, however, that other expedients known to those skilled in the art or disclosed herein may be employed without departing from the spirit of the invention or the scope of the appended claims.

We claim:

1. A branched-chain aliphatic ester oil consisting essentially of a full ester of a branched-chain aliphatic polyol having from 2 to 6 primary hydroxyl groups selected from the group consisting of alkanepolyols having from 3 to 6 carbon atoms and alkoxyalkanepolyols having from 6 to 12 carbon atoms with a mixture of (A) α-branched-chain alkanoic acids having the formula

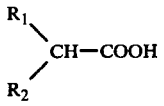

wherein $R_1$ and $R_2$ are alkyl having from 1 to 19 carbon atoms and the total number of carbon atoms in the acid is from 14 to 22, selected from the group consisting of (1) acids derived from the oxidation of α-branched alcohols formed from normal alcohols by the Guerbet synthesis and (2) an acid of the formula

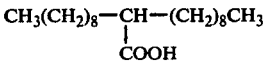

and (B) straight-chain alkanoic acids having from 8 to 10 carbon atoms, in such a ratio wherein at least one of said primary hydroxyl groups is on average at least 80% esterified by said α-branched-chain alkanoic acids and at least one of said primary hydroxyl groups is on average at least 40% esterified by said straight-chain alkanoic acids.

2. The ester oil of claim 1 wherein said α-branched alkanoic acid has 16 carbon atoms.

3. The ester oil of claim 2 wherein said α-branched $C_{16}$-alkanoic acid is an isopalmitic acid obtained by oxidation of the 2-hexyl-decanol formed from n-octanol by the Guerbet synthesis.

4. The ester oil of claim 1 wherein said straight-chain alkanoic acid is a mixture of acids having 8 to 10 carbon atoms.

5. The ester oil of claim 1 wherein said polyol is a branched-chain alkanepolyol having only 2 to 4 primary hydroxyl groups.

6. The ester oil of claim 5 wherein said alkanepolyol is trimethylolpropane.

7. The ester oil of claim 5 wherein said alkanepolyol is pentaerythritol.

8. The ester oil of claim 1 wherein the ratio of branched-chain acids to straight-chain acids is such that at least one primary hydroxyl group is esterified with said branched-chain acids and at least one primary hydroxyl group is esterified with said straight-chain acids.

9. Lubricating and hydraulic fluid compositions containing from 20% to 100% by weight of at least one ester oil of claim 1.

10. In the process of facilitating the motion of one solid over the surface of another solid by providing a thin film of a lubricant between the surfaces of said solids in frictional contact, the improvement consisting essentially of utilizing at least one ester oil of claim 1 as said lubricant.

11. The ester oil of claim 1 being the monoisopalmitic acid-di-n-$C_{8-10}$ alkanoic acid ester of trimethylolpropane, said isopalmitic acid being obtained by the oxidation of 2-hexyldecanol formed from n-octanol by the Guerbet synthesis.

* * * * *